US009410709B2

(12) United States Patent
Kopko et al.

(10) Patent No.: US 9,410,709 B2
(45) Date of Patent: Aug. 9, 2016

(54) MULTICHANNEL CONDENSER COIL WITH REFRIGERANT STORAGE RECEIVER

(75) Inventors: William L. Kopko, Jacobus, PA (US); Jose Ruel Yalung De La Cruz, Dover, PA (US)

(73) Assignee: Johnson Controls Technology Company, Holland, MI (US)

( * ) Notice: Subject to any disclaimer, the term of this patent is extended or adjusted under 35 U.S.C. 154(b) by 1436 days.

(21) Appl. No.: 12/594,730

(22) PCT Filed: Apr. 4, 2008

(86) PCT No.: PCT/US2008/059488

§ 371 (c)(1),
(2), (4) Date: Feb. 23, 2010

(87) PCT Pub. No.: WO2008/124637

PCT Pub. Date: Oct. 16, 2008

(65) Prior Publication Data

US 2010/0162739 A1 Jul. 1, 2010

Related U.S. Application Data

(60) Provisional application No. 60/910,334, filed on Apr. 5, 2007.

(51) Int. Cl.

| | |
|---|---|
| ***F25B 1/00*** | (2006.01) |
| ***F24F 1/16*** | (2011.01) |
| ***F24F 1/50*** | (2011.01) |
| ***F24F 1/68*** | (2011.01) |
| ***F25B 39/04*** | (2006.01) |
| ***F25D 23/00*** | (2006.01) |

(52) U.S. Cl.

CPC ... *F24F 1/16* (2013.01); *F24F 1/50* (2013.01); *F24F 1/68* (2013.01); *F25B 39/04* (2013.01); *F25D 23/00* (2013.01); *F25B 2400/16* (2013.01)

(58) Field of Classification Search

CPC ..... F25B 2339/044; F25B 2345/003; F25B 2345/002; F25B 2400/19; F25B 2600/2523

USPC ..... 62/174, 149, 292, 529, 115, 498, 77, 62/503, 175; 165/70, 71, 302

See application file for complete search history.

(56) References Cited

U.S. PATENT DOCUMENTS

| | | | | | |
|---|---|---|---|---|---|
| 3,010,289 | A * | 11/1961 | Kuklinski | F25B 27/00 | 62/196.1 |
| 3,392,542 | A * | 7/1968 | Nussbaum | F25B 47/022 | 62/196.4 |
| 3,939,668 | A * | 2/1976 | Morris | F25B 41/00 | 62/117 |
| 4,757,696 | A | 7/1988 | Gannaway | | |
| 4,841,739 | A * | 6/1989 | Wallner | | 62/174 |

(Continued)

FOREIGN PATENT DOCUMENTS

| | | | | |
|---|---|---|---|---|
| EP | 1150076 A2 | 10/2001 | | |
| EP | 2078906 A2 * | 7/2009 | | F25B 39/04 |
| JP | 01-124588 A1 | 5/1989 | | |

(Continued)

*Primary Examiner* — Jonathan Bradford

(74) *Attorney, Agent, or Firm* — McNees Wallace & Nurick LLC

(57) ABSTRACT

A chiller including a condenser having a refrigerant-storage vessel in fluid communication with a multichannel heat exchanger is disclosed. The chiller further includes a compressor, an evaporator and an expansion device connected in a refrigerant circuit. The refrigerant-storage vessel provides system volume for pump down operations.

20 Claims, 7 Drawing Sheets

(56) References Cited

U.S. PATENT DOCUMENTS

| | | | | |
|---|---|---|---|---|
| 5,671,608 | A * | 9/1997 | Wiggs | F24J 3/08 165/45 |
| 6,427,480 | B1 | 8/2002 | Ito et al. | |
| 8,230,694 | B2 * | 7/2012 | Scarcella et al. | 62/292 |
| 2006/0144076 | A1 * | 7/2006 | Daddis et al. | 62/440 |
| 2010/0064723 | A1 * | 3/2010 | Kawakatsu | 62/507 |

FOREIGN PATENT DOCUMENTS

| | | | |
|---|---|---|---|
| JP | 03-067874 | A1 | 3/1991 |
| JP | 07-103617 | A | 4/1995 |
| JP | 10-009713 | A | 1/1998 |
| JP | 10-132429 | A1 | 5/1998 |
| JP | 2002228281 | A | 8/2002 |
| JP | 2002286333 | A | 10/2002 |
| JP | 2002323274 | A | 11/2002 |
| JP | 2004-045012 | A1 | 2/2004 |
| JP | 2004-138305 | A1 | 5/2004 |
| JP | 2004251488 | A | 9/2004 |
| JP | 2004-308968 | A1 | 11/2004 |
| WO | 96/20378 | A1 | 7/1996 |
| WO | 2006101569 | A2 | 9/2006 |

* cited by examiner

MULTICHANNEL CONDENSER COIL WITH REFRIGERANT STORAGE RECEIVER

CROSS REFERENCE TO RELATED APPLICATIONS

This application claims priority to Provisional Patent Application No. 60/910,334 filed Apr. 5, 2007, hereby incorporated by reference in the entirety into this application.

BACKGROUND

This application generally relates to multichannel heat exchanger applications in heating, ventilation, and air-conditioning (HVAC) systems. The application relates more specifically to a refrigerant-storage refrigerant-storage vessel configuration for a multichannel heat exchanger coil of a condenser.

It should be noted that the present discussion makes use of the term "multichannel" tubes or "multichannel heat exchanger" to refer to arrangements in which heat transfer tubes include a plurality of flow paths between manifolds that distribute flow to and collect flow from the tubes. A number of other terms may be used in the art for similar arrangements. Such alternative terms might include "microchannel" (sometimes intended to imply having fluid passages on the order of a micrometer and less), and "microport". Other terms sometimes used in the art include "parallel flow" and "brazed aluminum". However, all such arrangements and structures are intended to be included within the scope of the term "multichannel". In general, such "multichannel" tubes will include flow paths disposed along the width or in a plane of a generally flat, planar tube, although, again, the invention is not intended to be limited to any particular geometry unless otherwise specified in the appended claims.

In a typical multichannel heat exchanger or multichannel heat exchanger coil, a series of tube sections are physically and thermally connected by fins configured to permit airflow through the heat exchanger to transfer heat between the airflow and a circulating fluid such as water or refrigerant being circulated through the multichannel heat exchanger. The tube sections of the multichannel heat exchanger are oriented to extend either horizontally or vertically and each tube section has several tubes or channels that circulate the fluid. The outside of the tube section may be a continuous surface typically having an oval or generally rectangular shape.

Multichannel coils can offer significant cost and performance advantages compared to conventional round-tube condenser coils when used in an aircooled condenser. However, multichannel condenser coils have a much smaller internal volume than is available with conventional coils. ASHRAE 15-2004.9.11.4 states that "liquid receivers, if used, or parts of a system designed to receive the refrigerant charge during pump down shall have sufficient capacity to receive the pump down charge. The liquid shall not occupy more than 90% of the volume when the temperature of the refrigerant is 90° F. or 32° C.". More particularly, the smaller internal volume in microchannel coils often requires a condenser that incorporate a refrigerant-storage refrigerant-storage vessel, which may be referred to as a receiver or a refrigerant-storage vessel, in order to hold the refrigerant change for pump down or servicing to meet this requirement. For examples of prior art related to receivers, see the ASHRAE Handbooks.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to a refrigeration circuit with applications for heating, ventilation, and air-conditioning (HVAC) systems. In one embodiment, a chiller for use in an HVAC system is disclosed. The chiller includes a compressor, a condenser unit comprising at least one multichannel heat exchanger coil, an expansion device, and an evaporator. The HVAC system further includes a refrigerant-storage vessel configured to receive refrigerant from the multichannel heat exchanger coil.

Another embodiment relates to an HVAC system including a compressor, a condenser unit comprising at least one multichannel heat exchanger coil, an expansion device, an evaporator, and an air handling unit. The HVAC system further includes a refrigerant-storage vessel in fluid communication with a return header of the multichannel heat exchanger coil.

Another embodiment relates to a method of operating a refrigeration circuit including a compressor, a condenser unit comprising a multichannel heat exchanger coil, an expansion device, and an evaporator. The method further includes providing a refrigerant-storage vessel in fluid communication with the multichannel heat exchanger coil, and operating the refrigeration circuit under a normal operating condition. The refrigerant-storage vessel is configured to contain substantially all refrigerant vapor during normal refrigeration circuit operating condition.

Certain advantages of the embodiments described herein are improved liquid subcooling, which assures reliable performance of the expansion valve, better chiller control through the addition or subtraction of refrigerant charge, increased chiller cooling capacity, improved efficiency which meets ASHRAE 90.1, and cost reduction through reduced charge requirements.

Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which.

Wherever possible, the same reference numbers will be used throughout the drawings to refer to the same or like parts.

DETAILED DESCRIPTION OF THE EXEMPLARY EMBODIMENTS

Before turning to the figures, which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
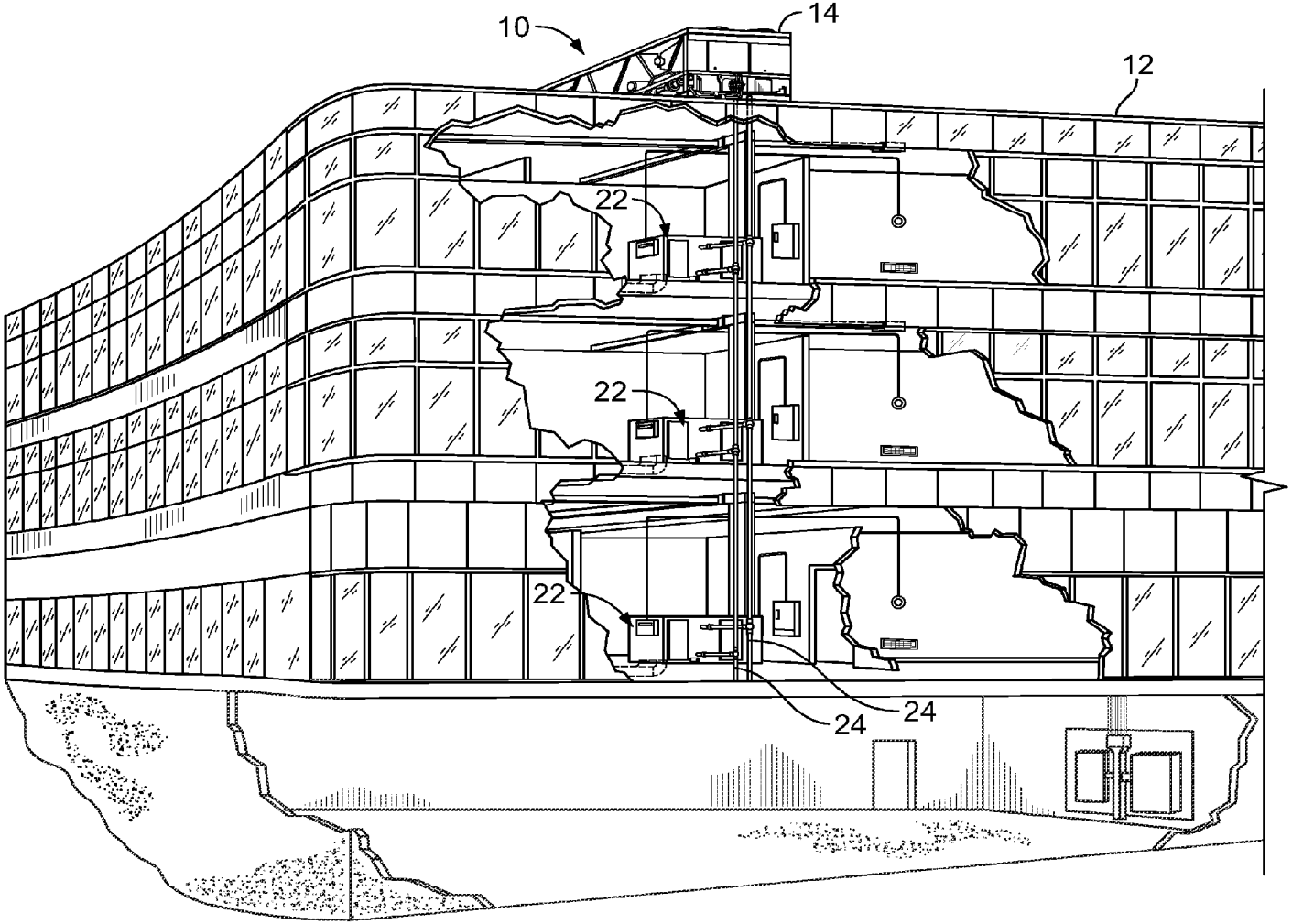
FIG. 1 is an illustration of an exemplary environment using an exemplary HVAC system according to the disclosure.

Referring to FIG. 1, an exemplary environment using an HVAC system 10 according to the disclosure is shown. As shown in FIG. 1, the HVAC system 10 provides cooling to a commercial building 12. In alternative embodiments, the HVAC system 10 may be used in commercial, light industrial, industrial, and in any other suitable applications for providing cooling in areas, such as a building, structure, and so forth. HVAC system 10 includes an air cooled packaged chiller (chiller) 14 and at least one air handling unit 22. The HVAC system 10 further includes associated supply and return lines 24 in fluid communication between chiller 14 and at least one air handling unit 22. Chiller 14 provides a cooled fluid, for example water, to at least one air handling unit 22 where it provides cooling to yet another fluid, most often building air, by conventional heat exchange methods known in the art, to provide cooling to building 12. In alternative embodiments, the cooled fluid may be any fluid that may provide heat exchange with air handling unit 22, for example a refrigerant. It should be appreciated by one of ordinary skill that chiller 14 is not limited to being disposed atop building 12, but may be located outside building 12 at any location. In alternative embodiments, some components of chiller 14 may be located within building 12. HVAC system 10 includes many other features that are not shown and/or described in FIG. 1, such as connective piping and electrical features. These features have been purposely omitted to simplify the drawing for ease of illustration.

Figure 2:
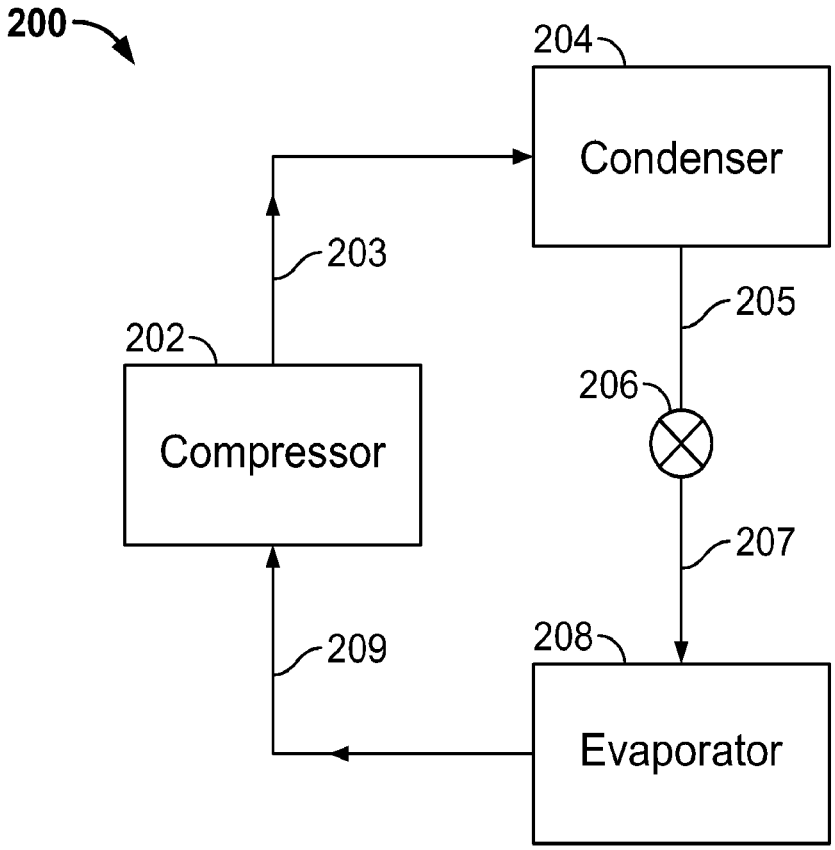
FIG. 2 is a schematic of an exemplary refrigeration circuit.

FIG. 2 shows an exemplary refrigeration circuit 200. Refrigeration circuit 200 includes a compressor 202, a condenser 204, an expansion device 206, and an evaporator 208. Circulating through refrigeration circuit 200 is a refrigerant, examples of which are discussed below, which completes a refrigeration cycle through refrigeration circuit 200.

Compressor 202 compresses vapor refrigerant and delivers the vapor refrigerant to condenser 204 through a compressor discharge line 203. Compressor 202 can be any suitable type of compressor. For example, compressor 202 may be a screw compressor, reciprocating compressor, centrifugal compressor, rotary compressor, swing link compressor, scroll compressor, turbine compressor, or any other suitable compressor as known in the art. The refrigerant may be any suitable refrigerant as is known in the art. For example, the refrigerant may be a hydrofluorocarbon (HFC) based refrigerant such as R-410A, R-407, or R-134a. Additionally, the refrigerant may be carbon dioxide (also known as R-744), $CO_2$, ammonia (also known as R-717), $NH_3$, HFO1234yf ($CF_3CF{=}CH_3$) or other similar or equivalent compound or mixture of compounds that are suitable for use as a working fluid in a vapor-compression refrigeration cycle.

Compressor 202 is driven by a motor (not shown), which may be integral to the compressor 202. The motor can be powered by a variable speed drive (VSD) (not shown) or can be powered directly from an AC or DC power source (not shown), as would be appreciated by one of ordinary skill in the art. For example, the motor can be a switched reluctance (SR) motor, an induction motor, an electronically commutated permanent magnet motor (ECM) or any other suitable motor type. The VSD, if used, receives AC power having a particular fixed line voltage and fixed line frequency from an AC power source and provides power to the motor having a variable voltage and frequency. In an alternate embodiment, other drive mechanisms such as steam or gas turbines or engines and associated components can be used to drive compressor 202.

At condenser 204, the vapor refrigerant enters into a heat exchange relationship with a fluid, e.g., air, and undergoes a phase change to a liquid refrigerant as a result of the heat exchange relationship with the fluid. The refrigerant from condenser 204 is then provided by a refrigerant liquid line 205 to expansion device 206, which reduces the pressure of the refrigerant before it is provided to evaporator 208 via an evaporator refrigerant inlet line 207.

At evaporator 208, the refrigerant enters into a heat exchange relationship with another fluid, which may or may not be the same type of fluid used for condenser 204, and undergoes a phase change to a vapor refrigerant as a result of the heat exchange relationship with the fluid. For example, at evaporator 208, the refrigerant may exchange heat with water. The refrigerant is provided from evaporator 206 to compressor 202 by a compressor suction line 209 to complete the refrigeration cycle.

As can be appreciated in light of the refrigerant system and circuit described herein, efficient heat exchange with secondary fluids outside of the circuit, for example, at the condenser 204, is important to the overall efficiency of the refrigeration circuit and the overall efficiency of the refrigeration system described above. Additionally, it can be appreciated that refrigerant in liquid or vapor phase continuously occupies the circuit. Therefore, in order to allow refrigerant to be removed or pumped down from compressor 202, refrigerant liquid line 205, or evaporator 208 without removing refrigerant from the circuit, a device must be added to the circuit to temporarily contain the pumped down refrigerant. In addition to allowing for easier servicing of these components, pumpdown can be used to ensure that evaporator 208 contains little or no liquid refrigerant at start up, which reduces potential problems with liquid damage to compressor 202 during start-up conditions.

A control system (not shown) may be provided to control operation of compressor 202. The control system may include an analog to digital (A/D) converter, a microprocessor, a non-volatile memory, and an interface board. Preferably, the control system can execute a control algorithm(s) to control operation of compressor 202. Additionally, the control system may provide other control operations and monitoring systems to refrigeration circuit 200, as would be appreciated by one of ordinary skill in the art. While the control algorithm can be embodied in a computer program(s) and executed by the microprocessor, it is to be understood that the control algorithm may be implemented and executed using digital and/or analog hardware by those skilled in the art. If hardware is used to execute the control algorithm, the corresponding configuration of the control system can be changed to incorporate the necessary components and to remove any components that may no longer be required.

Compressor 202, condenser 204, expansion device 205, and evaporator 208 form the major components of a refrigeration circuit of the chiller 14 (FIG. 1). Chiller 14 may include one or more refrigeration circuits and each circuit may share one or more components, including the major components.

Figure 3:
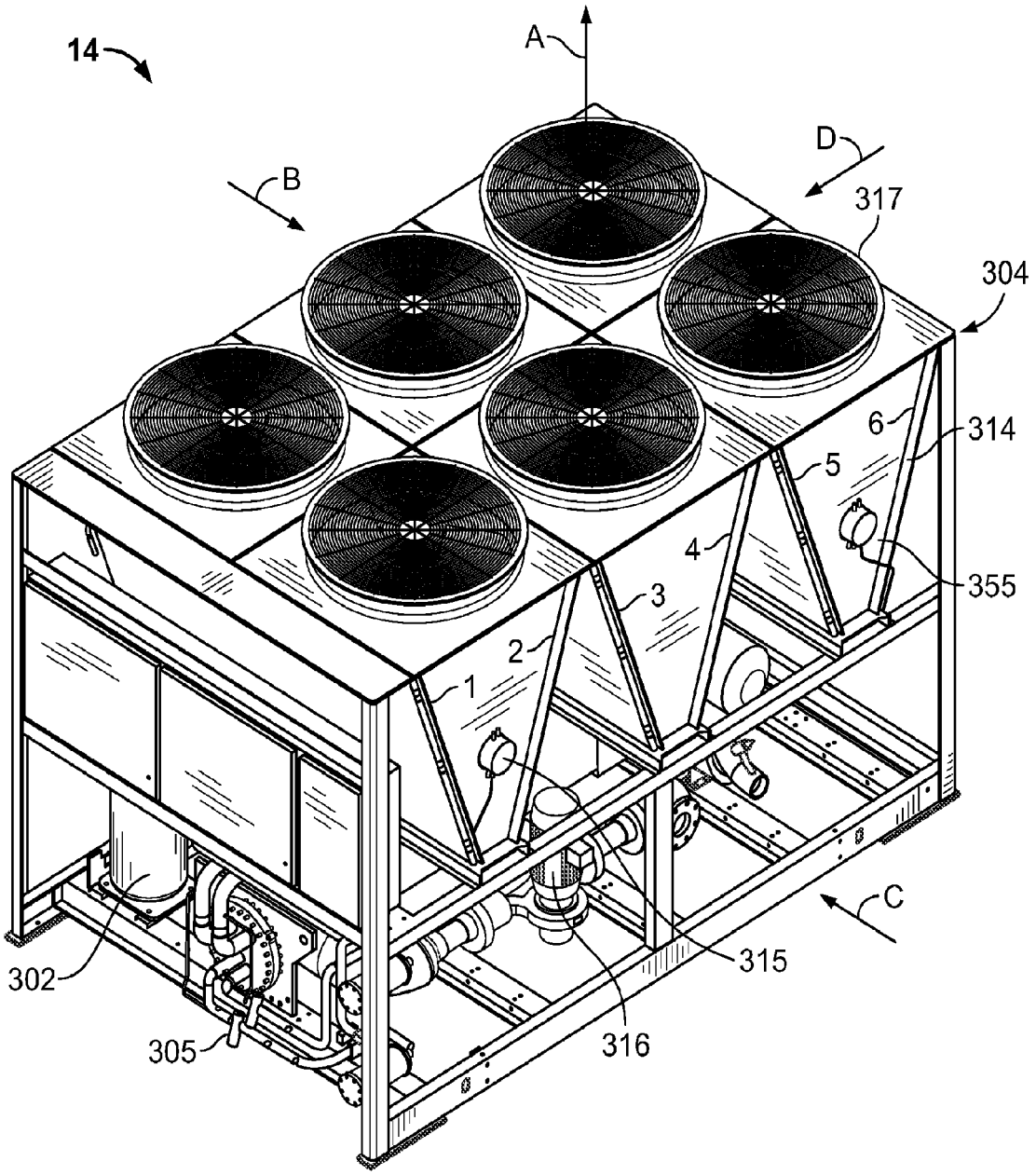
FIG. 3 is a perspective view of an exemplary embodiment of a condenser.
Figure 4:
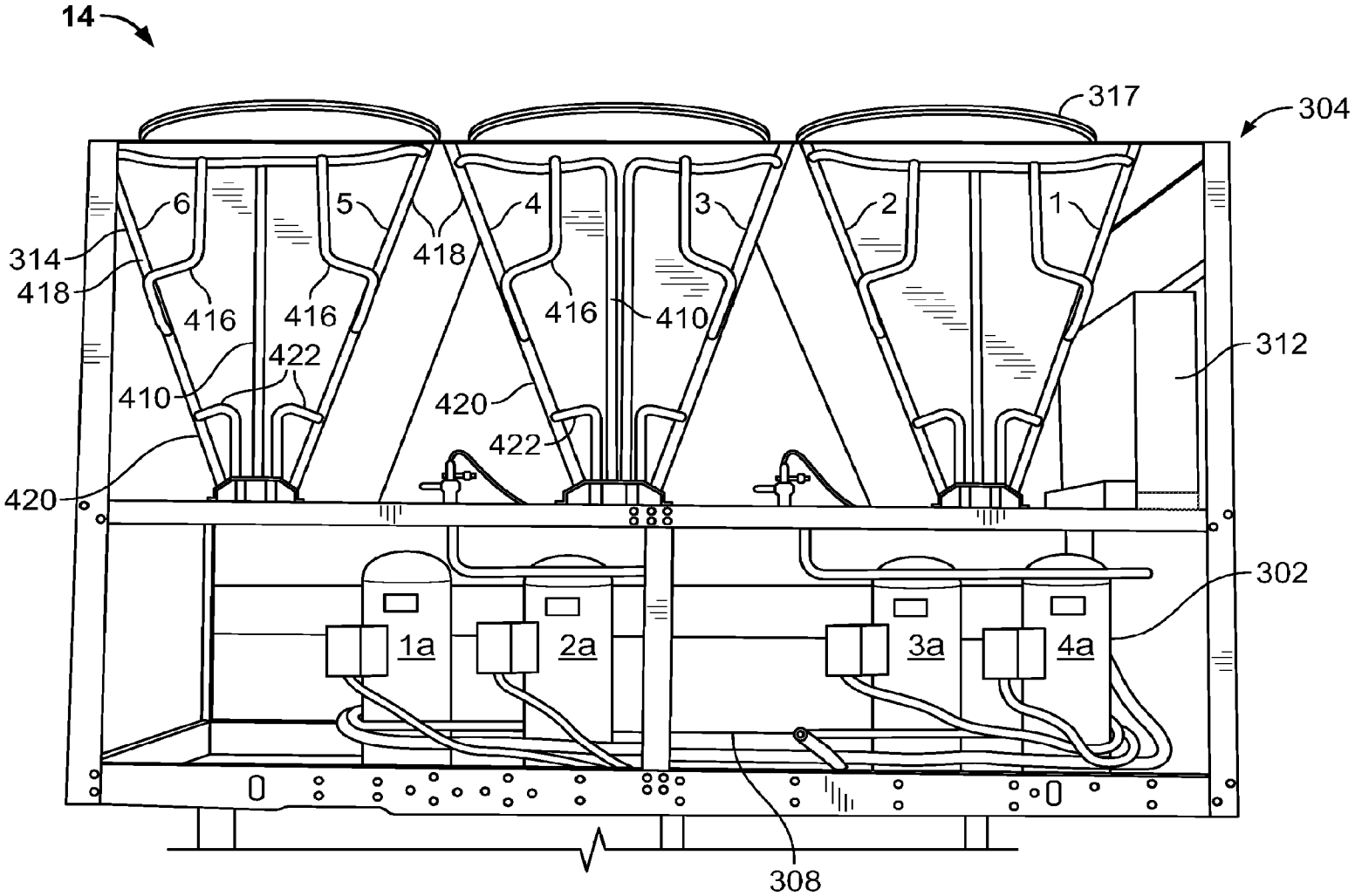
FIG. 4 is an end view of the condenser of FIG. 3 taken from direction B.
Figure 5:
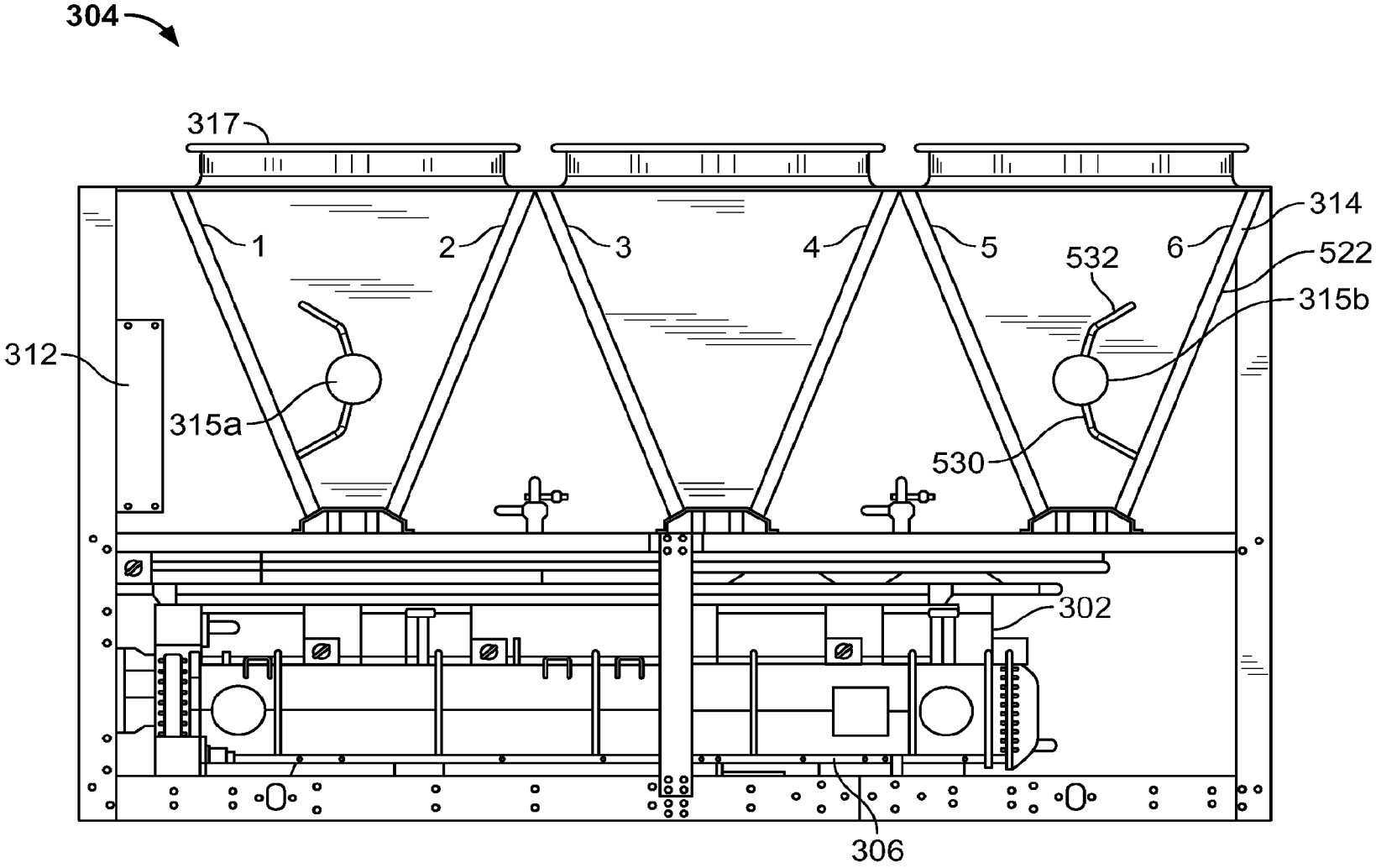
FIG. 5 is an end view of the condenser of FIG. 3 taken from direction C.

FIGS. 3-5 show an exemplary embodiment of chiller 14 according to the disclosure. Chiller 12 includes at least one compressor 302, a condenser 304, at least one expansion device 305, at least one evaporator 308, and controls 312. At least one compressor 302 have been consecutively numbered 1 through 4 as shown. Two compressors 302, designated as compressors 1*a* and 2*a*, are connected as part of the first refrigerant circuit, and two other compressors 4*a* and 5*a*, are connected as part of the second refrigerant circuit. For systems with scroll compressors, two or three compressor are normally used in each circuit to provide capacity control and to achieve a larger system capacity that would be available with a single compressor. Two or more refrigerant circuits are normally used with air-cooled chillers to allow for continued cooling in the event of a component failure in one refrigerant circuit. Multiple refrigerant circuits also allow for chiller capacities with more than three scroll compressor in a single circuit. Using more than three or four scroll compressors in a refrigerant circuit can result in low vapor velocity in the suction line if operated with a single compressor. The low velocity can lead to poor oil return from the evaporator, so it is generally preferable to use multiple refrigerant circuits instead of increasing the number of compressors beyond three or four in a single circuit.

In this exemplary embodiment, evaporator 306 is partitioned to provide separate heat exchange zones (not designated) for the first and second refrigerant circuits. However, in alternative embodiments, one or more evaporators 306 may be used and configured as necessary as would be appreciated by one of ordinary skill in the art to provide heat exchange between the refrigerant and the cooling fluid provided to at least one air handling unit 22 (FIG. 1). Pump 316 may be provided with chiller 14 that provides for the flow of the cooling fluid between evaporator 308 and at least one air handling unit 22. In alternative embodiments, pump 316 may be separate from chiller 14.

Condenser 304 includes at least one multichannel heat exchanger coil (coils) 314, at least one refrigerant-storage vessel 315, and at least one blower unit 317. Refrigerant-storage vessel 315 may also be referred to as a receiver. Coils 314 are heat exchangers configured to exchange heat between a refrigerant flowing within coils 314 and a fluid passing over and/or through coils 314. For example, coils 314 may be microchannel heat exchanger coils or other similar heat exchanger coils as are known in the art.

In this exemplary embodiment, condenser 304 includes six coils 314, which have been consecutively numbered 1 through 6 as shown. Furthermore, in this exemplary embodiment, three coils 314, designated as coils 1, 2 and 3, are connected as part of a first refrigerant circuit, and three other coils 314, designated as coils 4, 5 and 6, are connected as part of a second refrigerant circuit. In alternative embodiments, condenser 304 may include one or more coils 314 configured in one or more refrigerant circuits, the number and configuration of coils 314 depending upon the cooling demand of chiller 12.

At least one blower unit 317 draws air into condenser 304 and exhausts air from condenser 304 in direction A. In this exemplary embodiment, chiller 14 includes six blower units 317. However, in alternative embodiments, more or less than six blower units 317 of varying size and configuration may be used as determined by the cooling demand of chiller 14. The condenser 304 includes end panels 320 and a bottom panel 322 (see FIG. 8) to assist in channeling substantially all of the cooling air drawn into condenser 304 by blower units 317 through coils 314.

Figure 6:
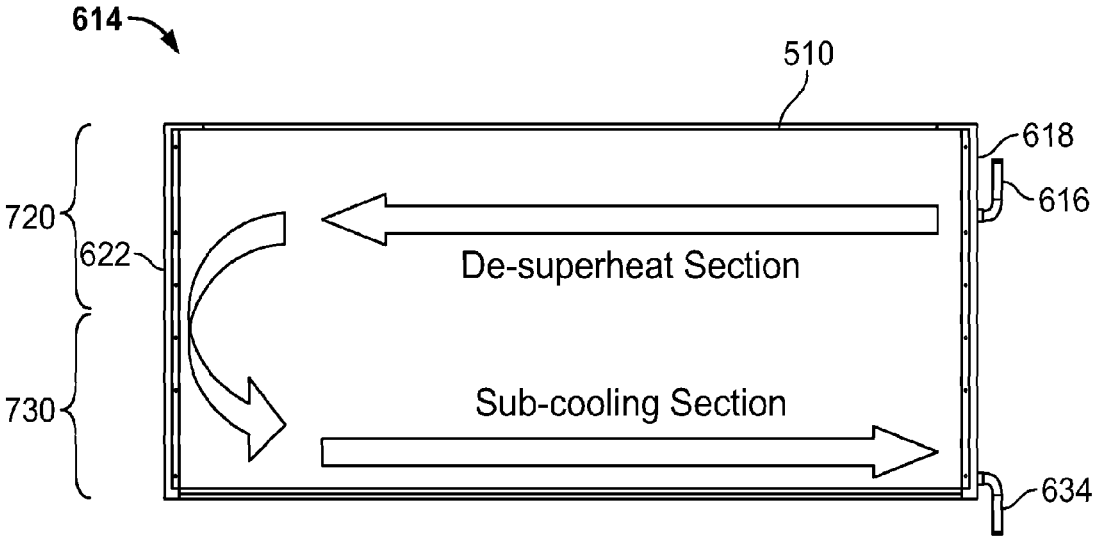
FIG. 6 is an illustration of an exemplary two pass heat exchanger coil.

A schematic representation of a two pass flow design coil (design coil) 614 is shown in FIG. 6. Header feed line 616 provides refrigerant vapor to a header 618 for distribution to rows of tubes (not shown) that span across an upper section 620 of design coil 614. Upper section 620, which may also be referred to as a de-superheat section, is configured to provide for a first pass of the refrigerant across design coil 614. During this first pass, the vapor refrigerant exchanges heat with cooling fluid, such as air, and is cooled. The refrigerant may also condense in upper section 620. After the refrigerant completes the first pass, the refrigerant is collected in a return header 622, which is configured to collect the refrigerant from upper section 620 and distribute the refrigerant to rows of tubes (not shown) in a lower section 630 of design coil 614. Lower section 630, which may also be referred to as the sub-cooling section, is configured to provide a second pass for the refrigerant through other rows of tubes (not shown) for further exchange of heat with the cooling fluid. Header 618 collects the refrigerant from the rows of tubes (not shown) forming the second pass, and provides the refrigerant to a refrigerant liquid line 634. Header 618 and return header 622 preferably are formed of a single tube with an internal partition that separates incoming flow of refrigerant vapor from outgoing flow of refrigerant liquid. Alternatively header 618 and return header 622 may be formed from physically separate tubes providing distribution and collection of refrigerant. It should be appreciated by one of ordinary skill, that the relative proportions of upper and lower sections 620, 630, respectively, and corresponding tubes (not shown) forming the first pass and return pass of the refrigerant, may vary based on application. Additionally, while design coil 614 of this exemplary embodiment is configured to provide a two-pass flow, a single pass or more than two-pass configuration may be used in condenser 614.

Figure 7:
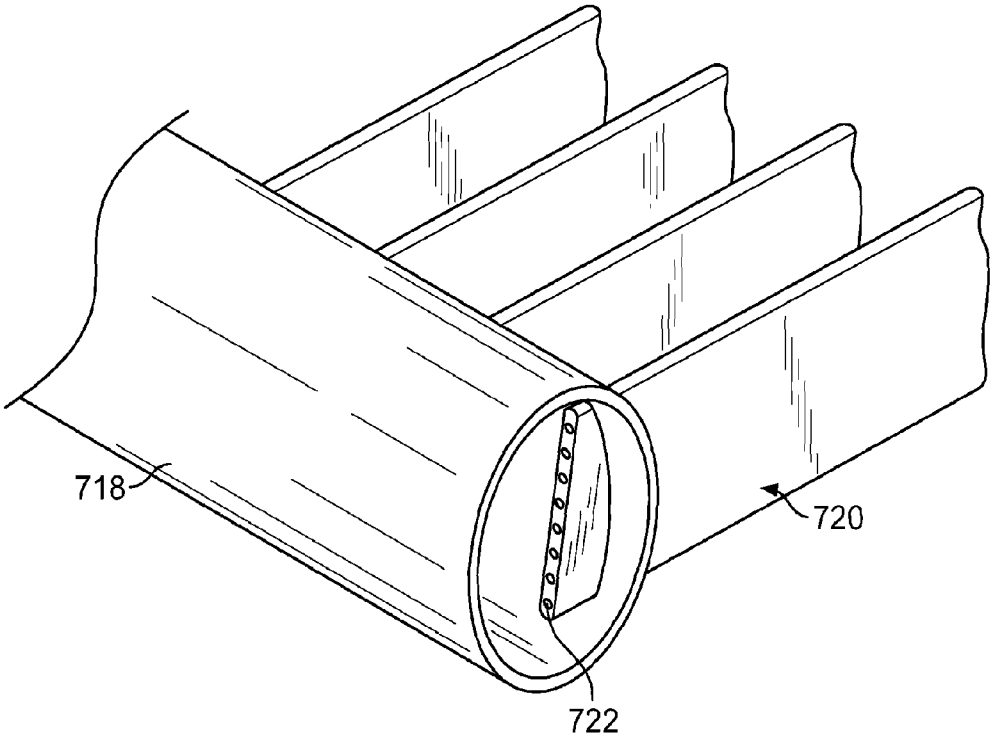
FIG. 7 is a partial view of a section of an exemplary heat exchanger coil.

FIG. 7 shows a partial section view of an exemplary configuration of a header 718 and tubes 720 for carrying refrigerant across a coil (not shown). Header 718 may be a feed, return or discharge header. Tubes 720 include passageways 722 that carry the refrigerant through tubes 720 where the refrigerant exchanges heat with air or another cooling fluid passing over tubes 720. In alternative embodiments, other suitable fluid distribution systems or structures may be used to distribute the refrigerant to tubes 720.

Tubes 720 can have a cross-sectional shape in the form or a rectangle, parallelogram, trapezoid, ellipse, oval or other similar geometric shape. Passageways 722 in tubes 720 can have a cross-sectional shape in the form of a rectangle, square, circle, oval, ellipse, triangle, trapezoid, parallelogram or other suitable geometric shape. In one embodiment, passageways 730 in tubes 720 can have a size, e.g., width or diameter, of between about a half (0.5) millimeter (mm) to about three (3) millimeters (mm). In another embodiment, passageways 730 in tubes 720 can have a size, e.g., width or diameter, of about one (1) millimeter (mm).

Connected between tubes 720 may be two or more fins or fin sections (not shown). In one embodiment, the fins can be arranged to extend substantially perpendicular to the flow of refrigerant in the tube sections. However, in another embodiment, the fins can be arranged to extend substantially parallel to the flow of refrigerant in the tube sections. The fins can be louvered fins, corrugated fins or any other suitable type of fin.

Tubes 720 can be of any suitable size and shape, including, but not limited to, generally rectangular, square, round, oval, triangular or other suitable geometric shape. Fins, plates or other similar heat exchange surfaces (not shown) may be disposed between or used in conjunction with tubes 720 to increase heat transfer efficiency from tubes 720 to the surrounding environment as is known in the art.

Referring to FIG. 4, condenser 304 further includes compressor discharge lines 410 that supply refrigerant vapor to inlet headers 418 by way of vapor feed lines 416. Compressor discharge lines 410 are in fluid communication to receive refrigerant vapor from at least one compressor 302, and in fluid communication to deliver refrigerant to vapor feed lines 416. Vapor feed lines 416 distribute refrigerant vapor to inlet headers 418 of coils 314. Inlet headers 418 are configured to provide refrigerant vapor to an upper portion (not shown) of coils 314 for a first pass through tubes (not shown) of coils 314. After the refrigerant makes the first pass, the refrigerant is collected by return headers 522 (see FIG. 5), which are located at the opposite of coils 314 from the inlet header 418. Return headers 522 distribute the refrigerant to a lower portion (not shown) of coils 314 for a second pass across other tubes (not shown) of the coils 314. After the refrigerant completes the second pass, the refrigerant is collected by liquid headers 420 that provide the refrigerant to liquid lines 422 configured to provide refrigerant to at least one expansion device 305 (FIG. 3).

As shown in FIGS. 1 and 5, condenser 304 further includes a refrigerant-storage vessel 315 in fluid communication with return headers 522 of coils 314 through refrigerant lines 530. Refrigerant-storage vessel 315 is also in fluid communication with a compressor discharge line 203 (FIG. 2) through hot gas lines 532. Compressor discharge line 203 (FIG. 2) provides vapor refrigerant to refrigerant-storage vessel 315. In alternative embodiments, hot gas lines 532 may be in fluid communication with other refrigerant lines containing vapor refrigerant. Refrigerant-storage vessel 315 provides for additional refrigerant circuit volume to provide for pump down refrigerant volume from other components of the refrigeration circuit.

The introduction of refrigerant vapor from hot gas lines 532 to refrigerant-storage vessel 315 vaporizes any liquid refrigerant present in refrigerant-storage vessel 315 during normal operating conditions, but permits liquid refrigerant from the refrigerant circuits to flow into refrigerant-storage vessel 315 during pump down operations.

The geometry of the hot gas lines 532 is important for proper control of refrigerant in refrigerant-storage vessel 315. For example, hot gas lines 532 may have an optimum nominal diameter of roughly ¼ to ⅜ inches for copper line that are several feet long. Hot gas lines 532 of significantly larger diameter can introduce an excessive quantity of warm refrigerant vapor to refrigerant-storage vessel 315, which may adversely affect the performance of the condenser 304 by introducing an excessive amount of refrigerant vapor to coils 314 through refrigerant lines 530. Hot gas lines 532 having a larger diameter may also raise the temperature of the walls of the refrigerant-storage vessel 315 to a high temperature that interferes with flow of liquid refrigerant into refrigerant-storage vessel 315 during pumpdown. Hot gas lines 530 having a smaller diameter may allow excessive amount of refrigerant liquid to remain in the refrigerant-storage vessel 315 during start-up or operating conditions, especially at lower ambient temperatures.

Location of the refrigerant-storage vessel 315 is preferably in the air stream leaving the coils 314. This location helps to keep the refrigerant-storage vessel 315 at a temperature that is near the refrigerant saturation temperature in the condenser 304. Other locations are also possible and do not prevent acceptable operation of the system.

Refrigerant lines 530 are preferably connected between a bottom of refrigerant-storage vessel 315 and a lower portion of return header 522. For example, a line nominal diameter of approximately ⅜ inch is sufficient to allow adequate flow of refrigerant between refrigerant-storage vessel 315 and coil 314. In alternative embodiments, multiple refrigerant lines 530 may be used for each refrigerant-storage vessel 315. In general, the bottom of the refrigerant-storage vessel 315 should be connected to coil 314 at location that is intermediate between vapor feed lines 416 and liquid lines 422.

While these embodiments show coils 314 having two refrigerant passes, other coil pass configurations are possible. For example, more than two refrigerant passes may be used. Depending on the details of the coil geometry and design conditions, three or more passes may be preferred. In this case, the preferred connection location for refrigerant line 530 to coil 314 is at a header at an entrance to a second or higher pass.

Connection to inlet header 418 is not preferred because of two important factors. First, liquid refrigerant cannot be present at this location until the coil is nearly full of liquid, which can result in at least one compressor 302 shutting down on high discharge pressure before a pumpdown is complete. A second factor is that there is almost no refrigerant pressure drop to drive a flow of refrigerant vapor to the refrigerant-storage vessel 315 at this location, which can result in liquid refrigerant accumulating refrigerant-storage vessel during normal chiller operation.

Furthermore, connection of the refrigerant line 530 at an outlet of coil 314 is also not preferred. The problem is that any refrigerant vapor that leaves refrigerant-storage vessel 315 goes directly into liquid line 530. This configuration may result in reduced subcooling and even vapor entering at least one expansion device 305, which can penalize system performance and can even create reliability issues unless a valve or other active control device is included in the hot-gas line 532 to prevent excessive flow of refrigerant vapor out of refrigerant-storage vessel 315.

In this exemplary embodiment, the condenser 304 includes two refrigerant-storage vessels 315 designated as a first refrigerant-storage vessel 315*a* and a second refrigerant-storage vessel 315*b*, as shown in FIG. 5. Refrigerant lines 530 are in fluid communication with return headers 522 proximate to where return headers 522 provide refrigerant to a lower section (not shown) of coils 314 at a location where return headers 522 contain substantially liquid refrigerant during normal condenser operations. Refrigerant lines 530 are also in fluid communication with the bottom of refrigerant-storage vessels 315*a*, 315*b* so as to be in fluid communication with any liquid refrigerant present in refrigerant-storage vessels 315*a*, 315*b*.

First refrigerant-storage vessel 315*a* is in fluid communication with coil 1 to provide pump down volume for the first refrigerant circuit, and second refrigerant-storage vessel 315*b*, is in fluid communication with coil 6 to provide pump down refrigerant volume for the second refrigerant circuit. Connecting refrigerant-storage vessels 315*a*, 315*b* to coils 1, 6, respectively, at only one return header location eliminates the possibility of pulling liquid into refrigerant-storage vessels 315*a*, 315*b* because of pressure differences between different return headers 522 (FIG. 5). In this exemplary embodiment, refrigerant lines 530 are connected to coils 1, 6 because in this condenser configuration, coils 1 and 6 have improved access to cooling air drawn by the blower units 317 flow compared to coils 2, 3, 4 and 5. The improved air flow access results in improved cooling and subcooling to coils 1, 6, which results in the refrigerant in the return headers 522 of coils 1, 6 is more likely to be liquid. In an alternative embodiment, a refrigerant-storage vessel 315 may be connected to any coils 1 through 6, and one or more than two refrigerant-storage vessels 315 may be used.

For example, in this exemplary embodiment, the configuration of refrigerant-storage vessels 315*a*, 315*b* as shown in this exemplary embodiment may permit refrigerant subcooling of about 15° F. to about 20° F. in condenser 314 without a significant amount of liquid refrigerant being present in refrigerant-storage vessels 315*a*, 315*b*. In other words, during normal refrigeration system operating conditions, refrigerant-storage vessels 315*a*, 315*b* contain substantially all vapor refrigerant.

Figure 8:
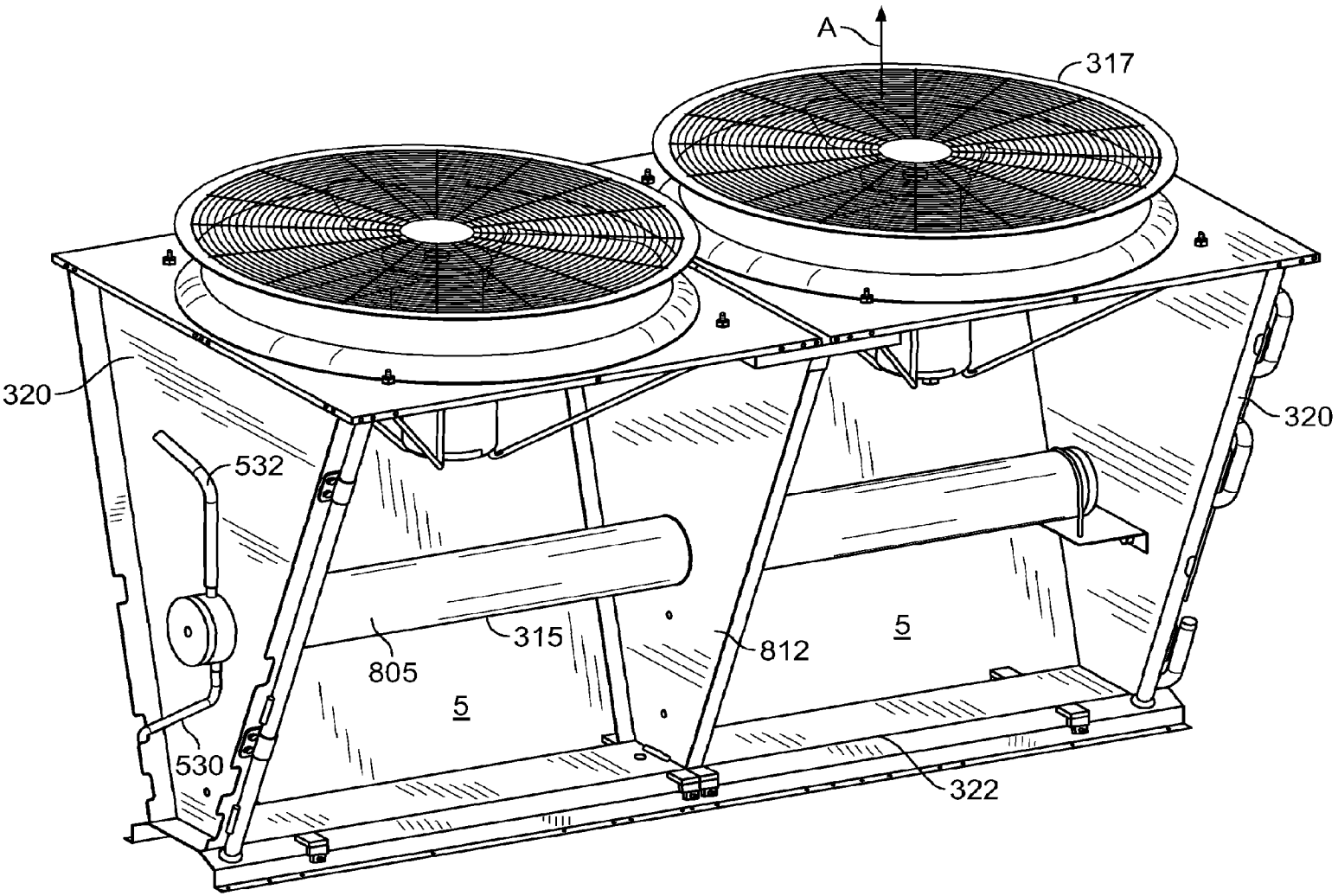
FIG. 8 is a top perspective view of a section of the condenser shown in FIG. 3 taken from direction D and having coil 6 removed.

FIG. 8 shows a side perspective view of a section of condenser 304 having coil 6 removed to view internal detail. As can be seen in FIG. 8, refrigerant-storage vessel 315 has a generally cylindrical geometry. Refrigerant-storage vessel 315 is a hollow cylinder, preferably with an internal diameter of less than six inches so as to be exempt from the ASME code for pressure vessels. Refrigerant-storage vessel 315 may be provided with an insulating outer layer 805, but in a preferred embodiment, the refrigerant-storage vessel has no insulating outer layer 805. Refrigerant-storage vessel 315 is supported by end walls 320 and an interior wall 812 disposed therebetween as shown in FIG. 8. However, in alternative embodiments, refrigerant-storage vessel 315 may be supported by any similar configuration of walls and supports.

At least one refrigerant-storage vessel 315 are configured to hold liquid refrigerant from a refrigeration circuit when a component of that refrigeration circuit is pumped down. Pumpdown is normally initiated immediately before shutdown of at least one compressor 302 in a refrigerant circuit. Pumpdown normally starts with controls 312 closing a liquid-line solenoid valve (not shown) located in the refrigerant circuit between condenser 304 and at least one expansion device 305. Closing the liquid-line solenoid valve stops the flow of refrigerant liquid out of condenser 304, which causes liquid refrigerant to back up into condenser 304. At least one compressor 302 continues to operate and to pump refrigerant vapor from at least one evaporator 308 to condenser 304. As the liquid refrigerant starts to accumulate in condenser 304 the heat-transfer surface area that is available for condensing refrigerant decreases, which causes a rapid rise in the condenser refrigerant pressure. The rapid increase in pressure causes liquid refrigerant to flow from return headers 522 of condenser 304 through refrigerant lines 530 that connect to at least one refrigerant-storage vessel 315, which allows liquid refrigerant to accumulate in at least one refrigerant-storage vessel 315. A pressure transducer (not shown) on compressor discharge line 203 (FIG. 2) in combination with controls 312 may reduce compressor capacity during the pumpdown process to prevent excessively high discharge pressures. A suction pressure transducer (not shown) in combination with controls 312 terminates the pumpdown process when the compressor suction pressure falls below a predetermined minimum value, which corresponds to a condition with little or no liquid refrigerant in at least one evaporator 308. The configuration of at least one refrigerant-storage vessel 315 in condenser 304 allows controls 312 to operate in a manner that is very similar to that for convention round-tube condenser coils that have sufficient internal volume to hold refrigerant liquid without a separate refrigerant storage vessel.

For storage of refrigerant for servicing or shipping, pumpdown may be initiated by manually closing service valve (not shown) located on the refrigerant liquid line 205 (FIG. 2). The service valve is normally located on refrigerant liquid line 205 between the condenser 304 and the liquid-line solenoid valve (not shown). Closing the service valve will cause liquid refrigerant to move into the condenser 304 and at least one refrigerant-storage vessel 315 in a process that is similar to that described above, except that the liquid-line solenoid valve remains open during the process. Controls 312 would normally closed the liquid-line solenoid valve only after the suction pressure drops below the specified minimum valve, which corresponds to the shutdown of at least one compressor 302.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

While only certain features and embodiments of the invention have been illustrated and described, many modifications and changes may occur to those skilled in the art (For example, variations in sizes, dimensions, structures, shapes and proportions of the various elements, values of parameters (For example, temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (For example, those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A system comprising:

a refrigerant loop comprising a compressor, a condenser comprising at least one multichannel heat exchanger coil, an expansion device, and an evaporator;

a vessel configured to store refrigerant;

the vessel comprising a first connection in continuous fluid communication with the multichannel heat exchanger coil via a first line and a second connection to directly and continuously receive refrigerant from a portion of the refrigerant loop in continuous fluid communication with the compressor via a second line, the first connection and the second connection being in continuous fluid communication with each other; and the vessel, the multichannel heat exchanger coil, and the first line being sized to store all of the refrigerant in the system during a pump down operation.

2. The system of claim 1, wherein the vessel is configured to store vapor refrigerant during non pump down operations of an operating system.

3. The system of claim 1, wherein the vessel is configured to store liquid refrigerant during pump down operations.

4. The system of claim 1, wherein the first connection is positioned at a bottom of the vessel.

5. The system of claim 1, wherein the multichannel heat exchanger coil comprises a header configured and positioned to provide for at least two refrigerant passes in the multichannel heat exchanger coil.

6. The system of claim 1, wherein the multichannel heat exchanger coil is a microchannel heat exchanger coil.

7. The system of claim 1, wherein the multichannel heat exchanger coil is air cooled.

8. The system of claim 5, wherein the first connection via the first line is in fluid communication with the header of the multichannel heat exchanger coil.

9. The system of claim 8, wherein the multichannel heat exchanger coil comprises an additional header comprising both a vapor line in fluid communication with the compressor and a liquid line in fluid communication with the expansion valve, and the first connection being in fluid communication with the additional header via the first line at a position intermediate the vapor line and the liquid line.

10. The system of claim 7, wherein the vessel is positioned downstream of the multichannel heat exchanger coil with respect to air flow through the multichannel heat exchanger.

11. The system of claim 1, wherein the at least one multichannel heat exchanger coil comprises a plurality of multichannel heat exchanger coils.

12. The system of claim 11, wherein the first connection via the first line is connected to only one multichannel heat exchanger coil of the plurality of multichannel heat exchanger coils.

13. A method of operating a refrigerant circuit including a compressor, a condenser comprising a multichannel heat exchanger coil, an expansion device, and an evaporator comprising:

fluidly connecting in continuous fluid communication a vessel via a first line to the multichannel heat exchanger coil at a location intermediate between a vapor feed line for the multichannel heat exchanger and a liquid discharge line for the multichannel heat exchanger;

fluidly connecting the vessel via a second line to directly and continuously receive refrigerant from a portion of the refrigerant circuit in continuous fluid communication with the compressor;

operating the refrigerant circuit under a normal operating condition; and containing only refrigerant vapor in the vessel during operation of the refrigerant circuit under the normal operating condition.

14. The method of claim 13, further comprising fluidly connecting the vessel to a refrigerant line containing refrigerant vapor during operation of the refrigerant circuit under the normal operating condition.

15. The method of claim 13, further comprising operating the refrigerant circuit during a pump down operation, and receiving and containing in the vessel refrigerant liquid from the multichannel heat exchanger during the pump down operation.

16. The method of claim 13, wherein fluidly connecting a vessel to the multichannel heat exchanger comprises connecting to the vessel at a bottom of the vessel and connecting to the multichannel heat exchanger at a return header of the multichannel heat exchanger coil.

17. The method of claim 13, further comprising configuring the multichannel heat exchanger coil to have two passes and connecting the vessel to the multichannel heat exchanger coil between the two passes.

18. The method of claim 15, wherein the vessel and multichannel heat exchanger coil are configured to store all of the refrigerant in the system during a pump down operation.

19. The method of claim 13, further comprising cooling the multichannel heat exchanger coil with a flow of air.

20. The method of claim 19, further comprising positioning the vessel downstream of the multichannel heat exchanger coil.

* * * * *